US005085440A

United States Patent [19]

Van Dam

[11] Patent Number: 5,085,440

[45] Date of Patent: Feb. 4, 1992

[54] BOARD GAME DEVICE

[76] Inventor: Ivan Van Dam, 5099 - 143rd Cir., Savage, Minn. 55378

[21] Appl. No.: 635,349

[22] Filed: Dec. 28, 1990

[51] Int. Cl.[5] ..... A63F 3/00

[52] U.S. Cl. ..... 273/241; 273/271; D21/23; D21/24

[58] Field of Search ..... 273/241, 271; D21/23, D21/24, 51, 52

[56] References Cited

U.S. PATENT DOCUMENTS

| | | | |
|---|---|---|---|
| D. 296,798 | 7/1988 | Smith | D21/23 |
| 2,313,473 | 3/1943 | Heacock | 273/241 |
| 3,464,701 | 2/1969 | Mahoney | 273/241 |
| 3,684,285 | 8/1972 | Kane | 273/241 |
| 3,879,040 | 4/1975 | Smith | 273/269 |
| 3,884,474 | 5/1975 | Harper | 273/241 |
| 3,888,487 | 6/1975 | Reploge | 273/269 |

FOREIGN PATENT DOCUMENTS

| | | | |
|---|---|---|---|
| 667737 | 3/1952 | United Kingdom | 273/241 |
| 1283840 | 8/1972 | United Kingdom | 273/241 |

OTHER PUBLICATIONS

"Original Plato Game", Creative Playthings Catalog 1969-70, 10/6/69.

*Primary Examiner*—Benjamin Layno

*Attorney, Agent, or Firm*—Palmatier & Sjoquist

[57] ABSTRACT

A three dimensional, multiplanar board game device is provided for which the game object is to place a plurality of game markers on the device in a straight line or row in any of the three available dimensions (X-Y-Z axes). A plurality of transparent boards each have a configured aperture therethrough and a square grid of marker seats. The number of the seats per each board equals the number of boards to the power of two. A support shaft or rod configured in cross section, as to pass through the configured aperture of each board, nonrotatably aligns the boards and the grids in a vertical arrangement with respect to each other. Hollow cylindrical spacers are provided to support the boards on the shaft in spaced relation adequate to permit hand insertion between the boards. A top handle is adapted to carry the device in a secured and assembled condition ready for play.

19 Claims, 6 Drawing Sheets

BOARD GAME DEVICE

BACKGROUND OF THE INVENTION

This invention relates to a board game. More particularly, this invention relates to a three dimensional, multiplanar board game device for which the game object is to place a plurality of game markers on the device in a straight line in any dimension.

Board games such as chess, tic tac toe and checkers are well known. However, these games are limited in that they are strictly two dimensional. That is, the game player may move any of his particular pieces in either a forward-reverse or a left-right lateral move. As such, these games are limited to two dimensional play. With respect to the traditional game of tic tac toe, the object of the game is to place three markers in a straight line in any of two dimensions along perhaps horizontal X-Y axes.

Three dimensional board games are known but are fraught with complexity in design and are cumbersome to play with. The game board devices require constant adjusting while the markers or game pieces are difficult to place in various available positions.

There is a need for a simple three dimensional, multiplanar board game device which will promote intellectual stimulation, forethought and planning. The preferably inexpensive device should permit the game players to easily play within three dimensions and should readily assemble and disassemble.

SUMMARY OF THE INVENTION

A three dimensional, multiplanar board game device is provided for which the game object is to place a plurality of game markers on the device in a straight line or row in any of the three available dimensions (X-Y-Z axes). A plurality of transparent boards each have a configured aperture therethrough and a square grid of marker seats. The number of the seats per each board equals the number of boards to the power of two. A support shaft or rod configured in cross section, as to pass through the configured aperture of each board, nonrotatably aligns the boards and the grids in a vertical arrangement with respect to each other. Hollow cylindrical spacer means are provided to support the boards on the shaft in spaced relation adequate to permit hand insertion between the boards. A top handle is adapted to carry the device in a secured and assembled condition ready for play.

A principle object and advantage of the present invention is that it provides a three dimensional multiplanar board game device which promotes intellectual stimulation, forethought and planning for individuals who utilize the present invention.

Another principle and advantage of the present invention is that it is quite simple and readily assembles and disassembles for easy use, storage and transportation.

Another principle object and advantage of the present invention is that it is relatively inexpensive, easy to use and has great aesthetic appearance. The device readily permits three dimensional play in a fashion so that the player can access and see all games markers on any level without hindrance as heretofore not known.

DETAILED SPECIFICATION

Figure 1:
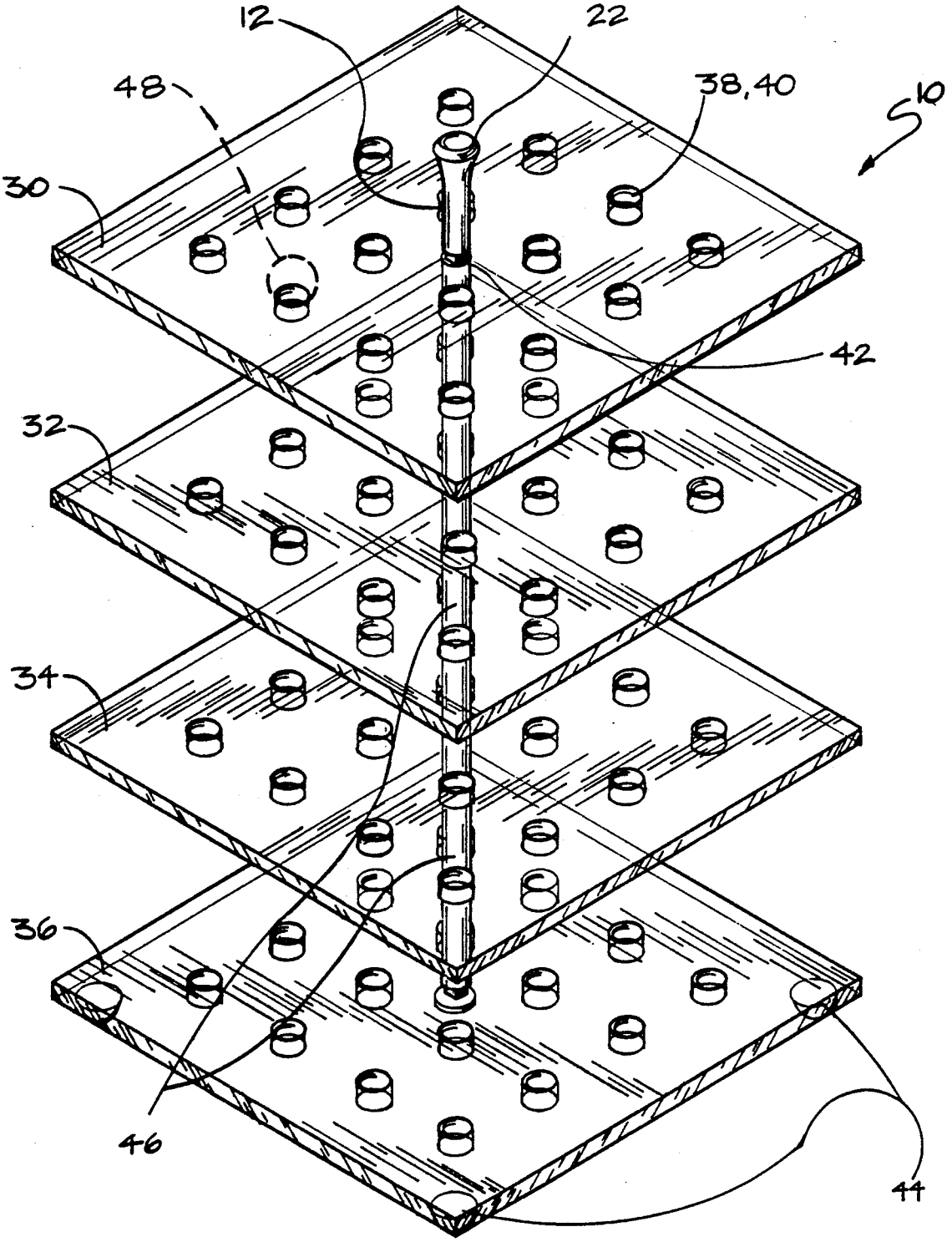
FIG. 1 is a perspective view of the game board device.

Referring to FIGS. 1-8, the three dimensional, multiplanar board game device 10 may be viewed. The device 10 generally includes a trunk or stem 12 which spatially supports in a vertical alignment clear or transparent game boards 30, 32, 24 and 36.

More specifically, the vertical trunk or stem 12 is suitably formed by a configured rod or support shaft 14. The rod 14 has a bottom end with a head 16. The intermediate portion 18 of rod 14 is preferably configured or square in cross section as will be appreciated later herein. The top end 20 of rod 14 is preferably threaded as to receive thereon a threadable top or handle 22 which has an inner threaded core.

The elements of the stem 12 appropriately may be metal. However, for safety reasons, the stem 12 may be made of nylon or synthetic polyamide resin as to permit collapse of the game device 10 to avoid impalement should an individual fall thereon. Aesthetically, the trunk or stem 12 appropriately should be chrome or of an attractive shiny finish as to add to the ornamental design of the board game device 10.

The board game device 10 suitably has top clear and transparent board 30, first intermediate transparent board 32, second intermediate transparent board 34 and bottom transparent board 36. The clear and transparent boards 30, 32, 34 and 36 appropriately may be vacuum molded out of a polyacrylate resin, commonly known as an acrylic. Plexiglass may also be used although the acrylic is more economical. As will be appreciated, it is important that boards 30, 32 24 and 36 are clear and transparent with high optical clarity to permit viewing of the entirety of each board from the virtually all angles normal to a player of the game.

Each board preferably has a grid 38 of sixteen holes or marker seats 40 through the boards. Appropriately the number of holes 40 is equal to the number of boards 30, 32, 34 and 36 to the exponential power of two. For example, four boards would require $24^2$ or $4\times4$ or sixteen (16) holes or seats 40. Three boards would require a grid 38 of nine holes 40 per board. Five boards would require a grid 38 of twenty-five holes 40.

Each board 30, 32, 34 and 36 has a centrally located configured hole or aperture 42. Hole 42 is preferably configured to be a square opening which will permit the intermediate portion 18 of configured rod 14 to pass therethrough. Once intermediate portion 18 of rod 14 has passed through the configured hole 42, the boards 30, 32, 34 and 36 are nonrotatably aligned in a vertical arrangement as to exhibit vertical symmetry with respect to the individual boards 30, 32, 34 and 36 and the grids 38 of sixteen holes 40. The bottom clear board 36 appropriately may have pliable bottom feet 44.

Cylindrical spacer means or hollow cylinders or tubes 46 are provided to be slid over configured rod 14 between boards 30 and 32; 32 and 34; and 34 and 36. The cylindrical spacers 46 are of an appropriate length as to spatially arrange the vertically aligned boards 30, 32, 34 and 36 adequate to permit an individual to reach in between the boards and place the game markers 48*a* and 48*b* in seats or holes 40. Markers 48*a* and 48*b* suitably are balls or spheres of two different colors having a diameter larger than the diameter of holes 40 as to properly seat the markers in the holes 40 without falling therethrough.

Assembly and disassembly of the board game device 10 may now be appreciated. The top end 20 of the configured rod 14 is passed through the configured hole 42 of the bottom board 36 up to the bottom end 16. A cylindrical spacer 46 is next slid over the configured rod 14 followed by the second intermediate board 34. The second intermediate board 34 and the bottom board 36 are nonrotatably interlocked by virtue of the configured rod 14 and configured holes 42. Another cylindrical spacer 46 is next passed over the configured rod 14 followed by the first intermediate board 32 which similarly becomes interlocked on configured rod or support shaft 14. Another cylindrical spacer 46 is passed over the configured rod 14 followed by the top board 30. Finally, the threadable top or handle 22 is threaded and tightened down onto configured rod 14 as to secure the assembled board game device 10. Thereafter the device 10 may be transported about by gripping the handle 22. Disassembly of the board game device 10 is just the reverse of assembly which makes the device 10 easily compact for storage or transportation.

Figure 2:
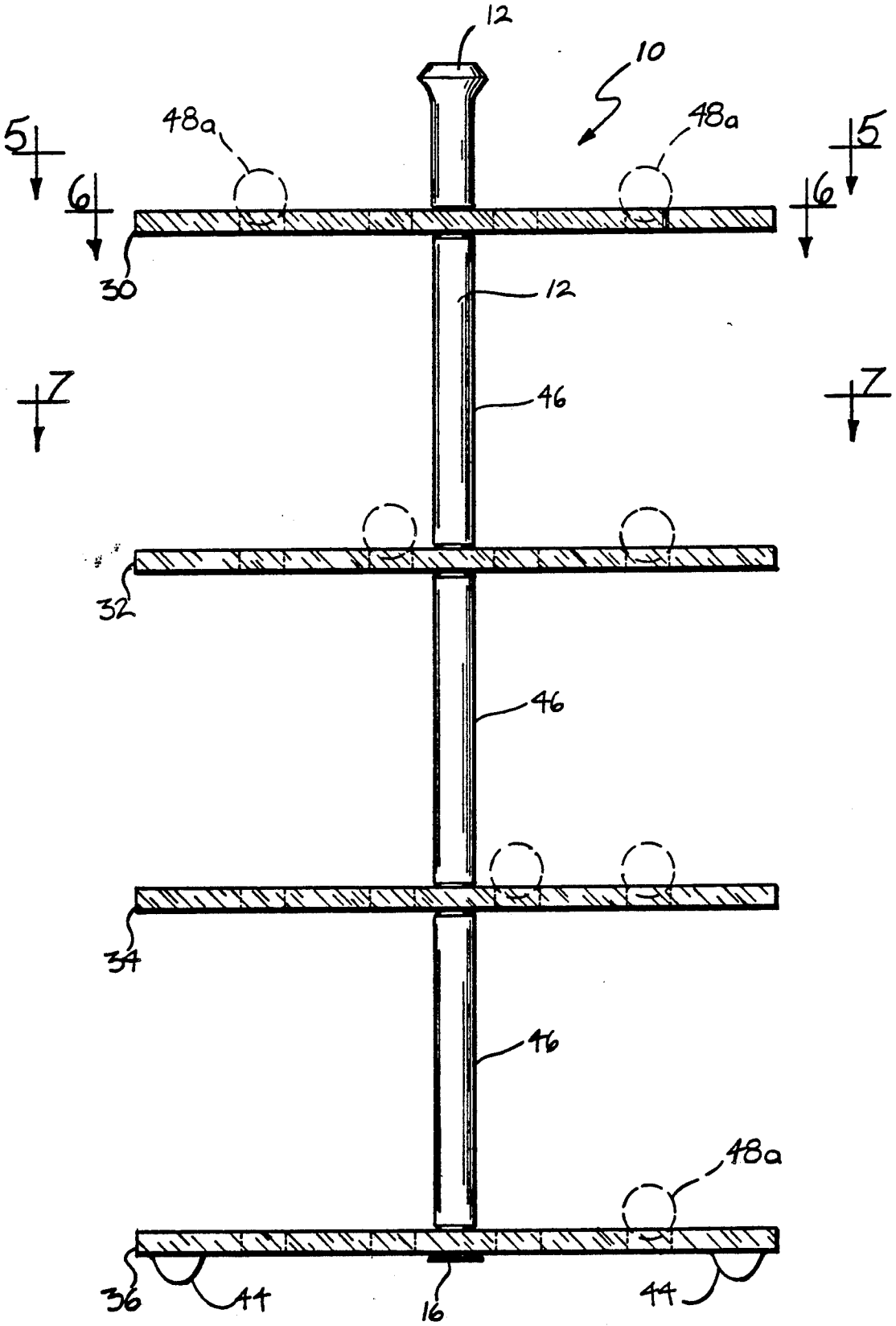
FIG. 2 is a side elevational view of any side of the invention with spherical markers in broken outline.
Figure 3:
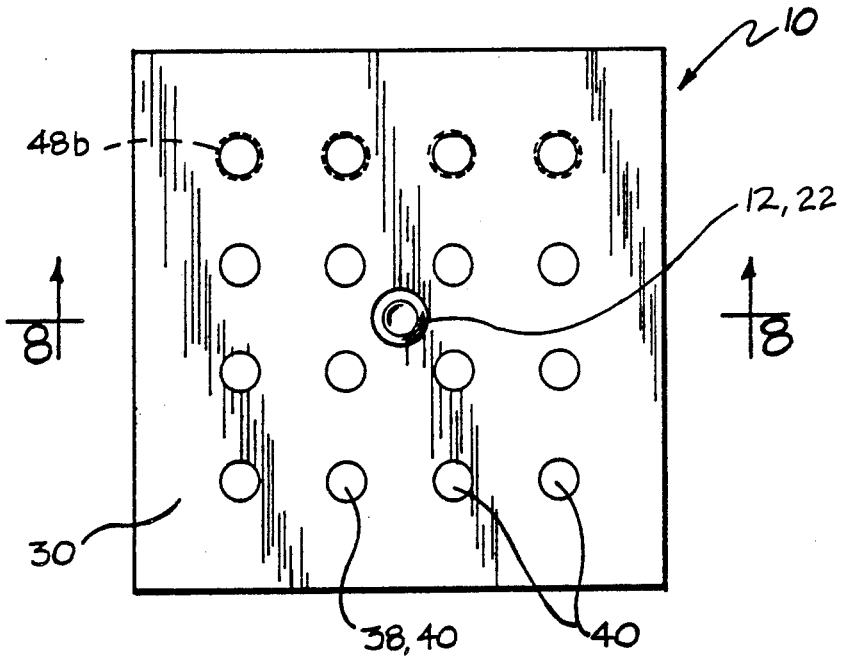
FIG. 3 is a top plan view of the game board device with spherical markers in broken outline.
Figure 4:
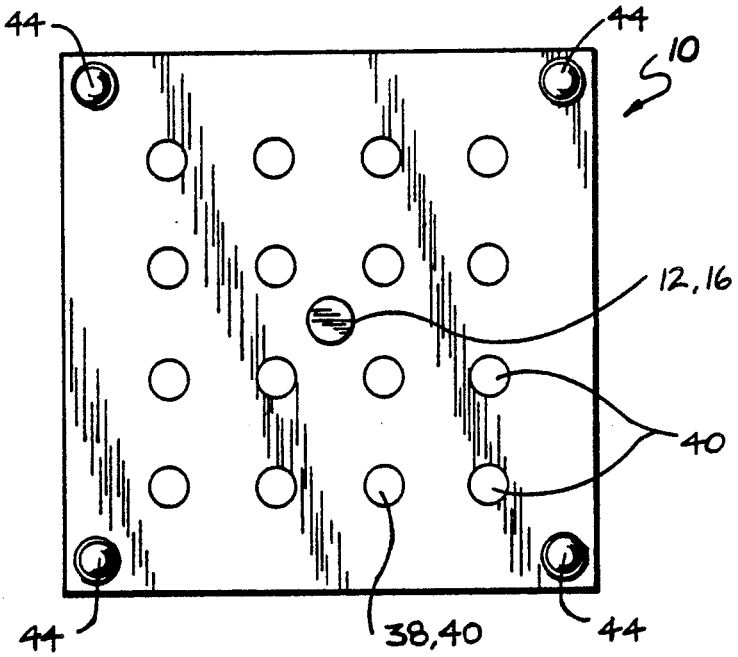
FIG. 4 is a bottom view of the invention.
Figure 5:
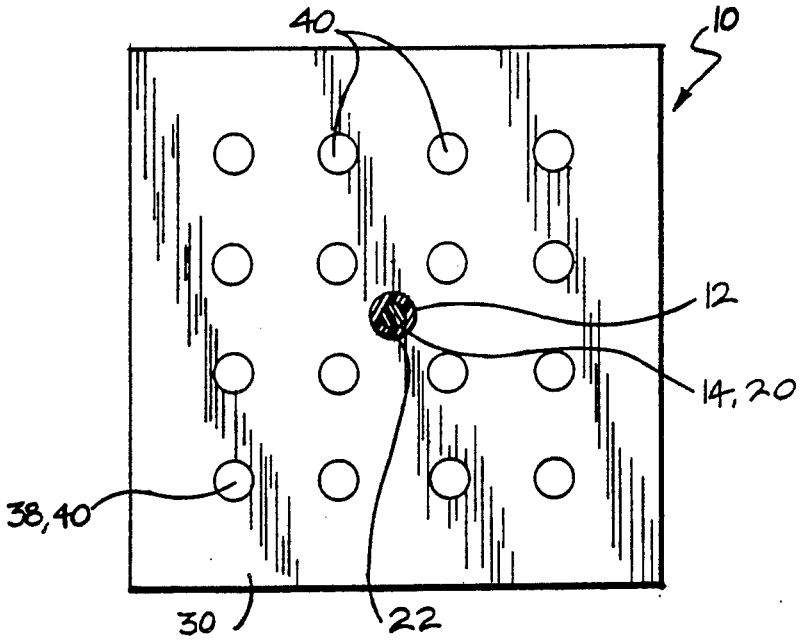
FIG. 5 is a cross sectional view of the invention taken along lines 5—5 of FIG. 2.
Figure 6:
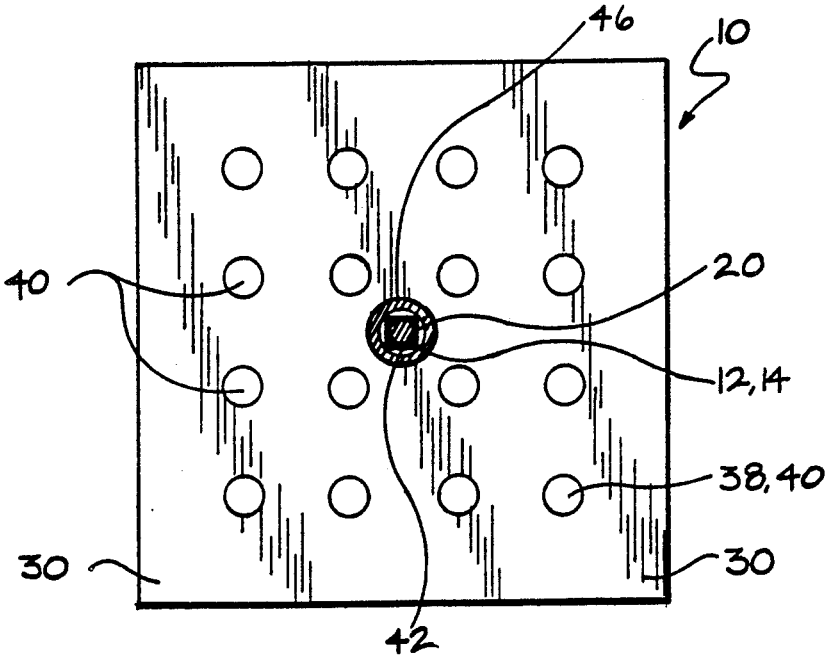
FIG. 6 is a cross sectional view of the invention taken along lines 6—6 of FIG. 2.
Figure 7:
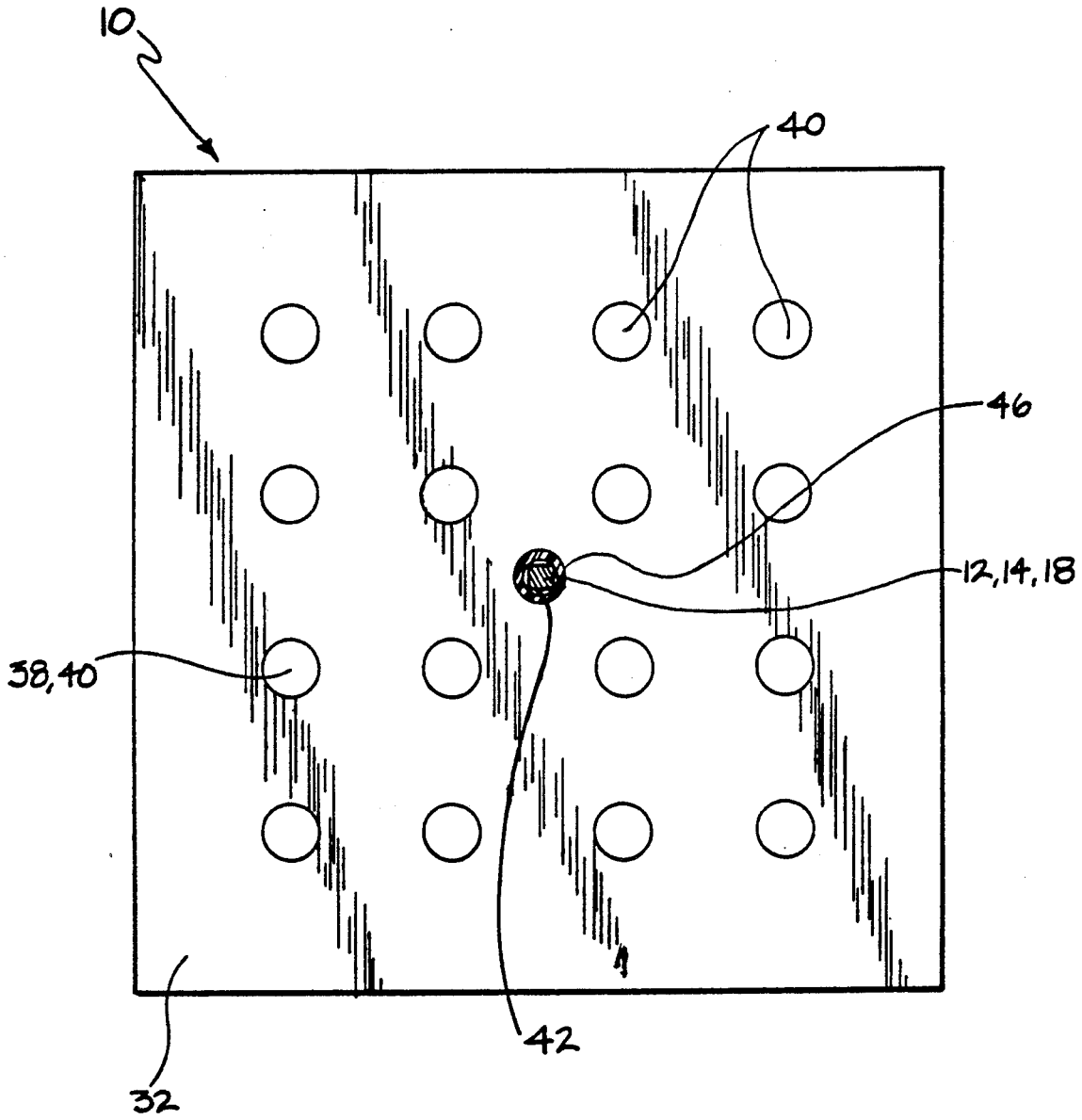
FIG. 7 is a cross sectional view of the invention taken along lines 7—7 of FIG. 2.
Figure 8:
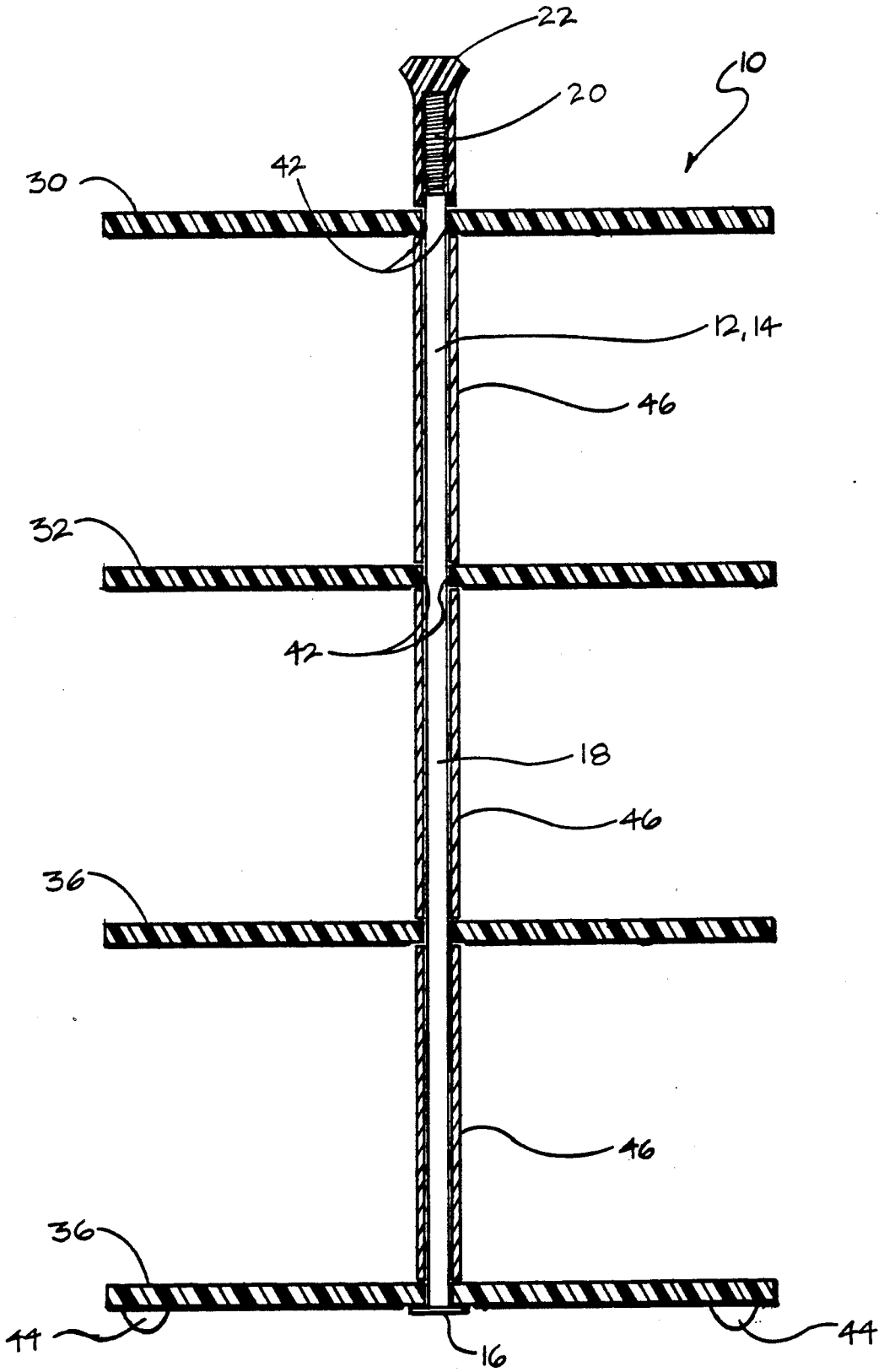
FIG. 8 is a cross sectional view taken along lines 8—8 of FIG. 3.

With the board game device assembled, the players may decide on the particular challenge of play in placing their respective game markers 48*a* and 48*b* on the device 10. Somewhat similar to tic tac toe, the object of the challenge is to align the markers 48*a* or 48*b* in a straight line or row in any of three planes or dimensions as shown in FIGS. 2 and 3. The players may decide to get four in a row on any one plane or dimension once, twice, three times or four times. One particular color of marker 48*a* or 48*b* may be designated to start. Appropriately only one marker should be placed on the board game device 10 at a time or per player turn.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A three dimensional, multiplanar board game device for which the game object is to place a plurality of game markers on the device in a straight line in any dimension, comprising:

(a) a plurality of transparent boards each with a configured aperture therethrough and a square grid of marker seats, the number of the seats per each board equaling the number of the boards to the power of two;

(c) a support shaft configured in cross section as to nonrotatably pass through the configured aperture of each board to nonrotatably align the boards and the grids in vertical arrangement with respect to each other, and (d) spacer means to support the boards on the shaft in spaced relation adequate to permit hand insertion between the boards.

2. The board game of claim 1, wherein the plurality of boards are four in number.

3. The board game of claim 1, where the boards are made of clear plastic.

4. The board game of claim 1, wherein the marker seats are round apertures through the boards having a diameter less than the diameter of the markers which are spherical.

5. The board game of claim 1, wherein the configured aperture and the shaft are square in shape.

6. The board game of claim 1, wherein the spacer means comprises hollow cylinders that will slide over the shaft but will not pass through the configured apertures of the board as to vertically align and space the boards apart.

7. The board game of claim 1, wherein the shaft has a threaded top end and a top handle adapted to be threadable onto the shaft to secure the device once assembled.

8. The board game of claim 1, wherein the shaft is made of metal

9. The board game of claim 1, wherein the shaft is made from a polyamide resin.

10. The board game of claim 1, where in the boards are made from a polyacrylate resin.

11. A three dimensional, multiplanar board game device for which the game object is to place a plurality of game markers on the device in a straight line in any dimension, comprising (a) a plurality of transparent boards each with a configured aperture therethrough and a square grid of marker seats, the number of the seats per each board equalling the number of the boards to the power of two;

(b) a support shaft configured in a cross section as to nonrotatably pass through the configured aperture of each board to nonrotatably align the boards and the grids in vertical arrangement with respect to each other; and (c) hollow cylinders that will slide over the shaft but will not pass through the configured apertures of the boards as to vertically align and space the boards apart adequate to permit hand insertion between the boards.

12. The board game of claim 11, wherein the shaft is made of metal.

13. The board game of claim 11, wherein the shaft is made from a polyamide resin.

14. The board game of claim 11, wherein the boards are made from a polyacrylate resin.

15. The board game of claim 11, wherein the plurality of boards are four in number.

16. The board game of claim 11, wherein the boards are made of clear plastic.

17. The board game of claim 11, wherein the marker seats are round apertures through the boards having a diameter less than the diameter of the markers which are spherical.

18. The board game of claim 11, wherein the configured apertures and the shaft are square in shape.

19. A three dimensional, multiplanar, board game device for which the game object is to place one or more sets of four spherical game markers on the device in a straight line in any dimension comprising:

(a) four transparent and clear plastic boards each with a configured aperture therethrough and a square grid of sixteen apertures in each board of a diameter less than the diameter of the spherical markers as to function as marker seats;

(b) a support shaft configured in cross section as to nonrotatably pass through the configured aperture of each board to nonrotatably align the boards and the grids in vertical arrangement with respect to each other having a threaded top end and a bottom head end;

(c) hollow cylindrical spacer means that will slide over the shaft between boards that will not pass through the configured apertures as to vertically align and space the boards adequate to permit hand insert between the boards; and (d) a top handle adapted to thread onto the top end of the shaft to secure the device once assembled and permit lifting and transporting of the device by the handle.

* * * * *